US009768515B2

(12) United States Patent
Rumpf et al.

(10) Patent No.: US 9,768,515 B2
(45) Date of Patent: Sep. 19, 2017

(54) ANISOTROPIC METAMATERIALS FOR ELECTROMAGNETIC COMPATIBILITY

(71) Applicant: Board of Regents, The University of Texas System, Austin, TX (US)

(72) Inventors: Raymond C. Rumpf, El Paso, TX (US); Cesar R. Garcia, Lancaster, CA (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 14/747,914

(22) Filed: Jun. 23, 2015

(65) Prior Publication Data

US 2016/0036132 A1 Feb. 4, 2016

Related U.S. Application Data

(60) Provisional application No. 62/016,478, filed on Jun. 24, 2014.

(51) Int. Cl.

| | |
|---|---|
| ***H01Q 15/02*** | (2006.01) |
| ***H01Q 15/00*** | (2006.01) |
| ***H01Q 1/52*** | (2006.01) |
| *H01Q 19/06* | (2006.01) |
| *H01Q 15/08* | (2006.01) |
| *H01Q 9/26* | (2006.01) |
| *H01Q 3/46* | (2006.01) |
| *H01Q 1/24* | (2006.01) |
| *H01Q 3/44* | (2006.01) |

(52) U.S. Cl.

CPC ..... *H01Q 15/0086* (2013.01); *H01Q 1/526* (2013.01); *H01Q 1/243* (2013.01); *H01Q 1/245* (2013.01); *H01Q 3/44* (2013.01); *H01Q 3/46* (2013.01); *H01Q 9/26* (2013.01); *H01Q 15/08* (2013.01); *H01Q 19/062* (2013.01)

(58) Field of Classification Search

CPC ..... H01Q 15/0006; H01Q 9/26; H01Q 15/08; H01Q 1/243; H01Q 3/44; H01Q 19/062; H01Q 3/46

USPC ..... 343/909, 908, 911, 702, 700, 753, 754

See application file for complete search history.

(56) References Cited

U.S. PATENT DOCUMENTS

2008/0258981 A1* 10/2008 Achour ..... H01Q 21/065 343/702

OTHER PUBLICATIONS

Aspnes, D. E., "Local-field effects and effective-medium theory: A microscopic perspective," Am. J. Phys. (1982) 50 (8):704-709.

Caloz, C. et al., Electromagnetic Metamaterials: Transmission Line Theory and Microwave Applications the Engineering Approach (2006) John Wiley & Sons, Inc., Hoboken, NJ, 71 pages.

Capolino, F. (ed.), Metatmaterials Handbook Theory and Phenomena of Metamaterials (2009) Taylor & Francis Group, Boca Raton, FL, 926 pages.

(Continued)

*Primary Examiner* — Joseph Lauture

(74) *Attorney, Agent, or Firm* — Kevin Soules; Kermit D. Lopez; Luis M. Ortiz

(57) ABSTRACT

Embodiments of the invention are directed to a device having one or more electromagnetic components embedded in an anisotropic metamaterial (AM) comprising an array of asymmetric unit cells comprising a substrate forming a plurality of channels or spaces having at least one material with different electromagnetic properties included in the channels or spaces in the first material forming an anisotropic metamaterial.

20 Claims, 19 Drawing Sheets

(56) References Cited

OTHER PUBLICATIONS

Garcia, C. R. et al., "3D Printing of Anisotropic Metamaterials," Progress in Electromagnetics Research Letters (2012) 34:75-82.
Gravelle, L. B. et al., "EMI/EMC in Printed Circuit Boards—A Literature Review," IEEE Transactions on Electromagnetic Compatibility (1992) 34(2):109-116.
Guo, S. et al., "Simple plane wave implementation for photonic crystal calculations," Optic Express (2003) 11 (2):167-175.
Hill, D. A. et al., "Crosstalk Between Microstrip Transmission Lines," IEEE Transactions on Electromagnetic Compatibility (1994) 36(4):314-321.
Isaacs, Jr., J. C. et al., "Crosstalk in Uniformly Coupled Lossy Transmission Lines," The Bell System Technical Journal (1973) 52(1):101-115.
Jaeger, H. M. et al., "Physics of the Granular State," Science (1992) 255(5051):1523-1531.
Johnson, S. G. et al., "Block-iterative frequency-domain methods for Maxwell's equations in a planewave basis," Optics Express (2001) 8(3):173-190.
Khurgin, J. B. et al., "Scaling of losses with size and wavelength in nanoplasmonics and metamaterials," Applied Physics Letters (2011) 99:211106-1-211106-3.
Kim, J. H. et al., "A Simple Method of Crosstalk Reduction by Metal Filled Via Hole Fence in Bent Transmission Lines on PCBs," 17th International Zurich Symposium on Electromagnetic Compatibility (2006) pp. 363-366.
Mallahzadeh, A. R. et al., "Crosstalk Reduction Using Step Shaped Transmission Line," Progress in Electromagnetics Research C (2010) 12:139-148.
Niklasson, G. A. et al., "Effective medium models for the optical properties of inhomogeneous materials," Applied Optics (1981) 20(1):26-30.
Pendry, J. B. et al., "Controlling Electromagnetic Fields," Science (2006) 312(5781):1780-1782.
Poh, S. Y. et al., "Approximate Formulas for Line Capacitance and Characteristic Impedance of Microstrip Line," IEEE Transactions on Microwave Theory and Techniques (1981) MTT-29(2):135-142.
Ponchak, G. E. et al., "Experimental Verification of the Use of Metal Filled Via Hole Fences for Crosstalk Control of Microstrip Lines in LTCC Packages," IEEE Transactions on Advanced Packaging (2001) 24(1):76-80.
Ponizovskaya, E. V. et al., "Losses for microwave transmission in metamaterials for producing left-handed materials: The strip wires," Applied Physics Letters (2002) 81(23):4470-4472.
Rumpf, R. C., "Design and Optimization of Nano-Optical Elements by Coupling Fabrication to Optical Behavior," Dissertation, University of Central Florida (2006), 345 pages.
Rumpf, R.C. et al., "Synthesis of spatially variant lattices," Optics Express (2012) 20(14):15263-15274.
Rumpf, R. C., "Simple Implementation of Arbitrarily Shaped Total-Field/Scattered-Field Regions in Finite-Difference Frequency-Domain," Progress in Electromagnetics Research B (2012) 36:221-248.
Rumpf, R. C. et al., "Electromagnetic Isolation of a Microstrip by Embedding in a Spatially Variant Anisotropic Metamaterial," Progress in Electromagnetics Research (2013) 142:243-260.
Sharma, R. et al., "Transient Analysis of Microstrip-Like Interconnections Guarded by Ground Tracks," Progress in Electromagnetics Research (2008) 82:189-202.
Wu, J. H. et al., "A Faraday Cage Isolation Structure for Substrate Crosstalk Suppression," IEEE Microwave and Wireless Components Letters (2001) 11(10):410-412.
Xiao, F. et al., "Analysis of Crosstalk Between Finite-Length Microstrip Lines: FDTD Approach and Circuit-Concept Modeling," IEEE Transactions on Electromagnetic Compatibility (2001) 43(4):573-578.

* cited by examiner

1105

1100

ANISOTROPIC METAMATERIALS FOR ELECTROMAGNETIC COMPATIBILITY

CROSS REFERENCE TO RELATED PATENT APPLICATIONS

This patent application claims the priority and benefit of U.S. provisional patent application 62/016,478, entitled "Anisotropic Metamaterials for Electromagnetic Compatibility," filed on Jun. 24, 2014. This patent application therefore claims priority to U.S. Provisional Patent Application Ser. No. 62/016,478, which is incorporated herein by reference in its entirety.

STATEMENT REGARDING FEDERALLY FUNDED RESEARCH

The invention disclosed in this application was made with government support under N66001-11-1-4150 awarded by the Department of Defense/Defense Advanced Research Projects Agency (DOD/DARPA). The government has certain rights in the invention.

FIELD OF THE INVENTION

This invention is generally related to methods and systems for improving compatibility of electromagnetic devices and components while reducing coupling and cross-talk by manipulation or sculpting of near field electronic and magnetic fields of electronic and electromagnetic components.

BACKGROUND 3D printing is poised to revolutionize manufacturing and transform the way electronics and electromagnetic devices are designed and manufactured. It offers the ability to arbitrarily place different materials in three dimensions with high precision. This capability will help to break away from traditional planar designs and to utilize the third dimension like never before. More functions can fit into the same amount of space, products with novel form factors can be more easily manufactured, interconnections can be routed more smoothly, interfaces can be better implemented, electrical and mechanical functions can be comingled, and entirely new device paradigms will be invented.

However, moving away from traditional planar topologies creates many new problems—like signal integrity, crosstalk, noise, and unintentional coupling between devices or components. A number of solutions have been proposed that reduce coupling and cross talk, including hole fences, guarded ground tracks, step shaped transmission lines, and even faraday cages. All of these approaches, however, use metals and can produce new problems in the framework of a 3D system because the isolation structures themselves occupy space, limit how closely components can be placed, and introduce electrical losses.

Thus, a need exists for materials and designs that improve the electromagnetic compatibility of devices and components by reducing coupling and cross-talk.

SUMMARY

Certain embodiments are directed to manipulation or sculpting of near field electronic and magnetic fields of electronic/electromagnetic components by embedding one or more electromagnetic components in an anisotropic metamaterial. In certain aspects the anisotropic metamaterial (AM) is a spatially variant anisotropic metamaterial (SVAM). In one aspect the AM or SVAM can be configured to sculpt the near-field of an electromagnetic component in a way so as to allow the components to be positioned in close proximity without coupling or interfering with each other. Multiple electromagnetic components can be embedded in an AM or SVAM to render them electromagnetically compatible in a particular configuration, reduce the envelope correlation coefficient (ECC), etc. As used herein close proximity can range from sub-millimeter distance to meters depending on the unsculpted near-field of embedded component(s). An electromagnetic component can be a transmission line, an antenna, a power source, a waveguide, filter, interfaces, impedance elements, or any component that produces a near-field that hinders or limits the positioning of the component or a second component in relation to the first component. In still a further aspect, the near-field can be sculpted such that the near-fields are more strongly coupled. The near-field characteristic can be engineered to meet a variety of conditions.

In certain aspects a device has one or more electromagnetic components embedded in an AM or SVAM comprising an array of asymmetric unit cells comprising a substrate (a first material) forming a plurality of channels, spaces, or lattice points for a second material, at least one material having different electromagnetic properties (i.e. dielectric constant, permeability, conductivity, etc.) forming an anisotropic metamaterial or a spatially variant anisotropic metamaterial. In certain aspects the substrate, or first material, can be a low dielectric or high dielectric material, and the second material can be a high dielectric or low dielectric material, respectively.

Certain embodiments are directed to a device having one or more electromagnetic components embedded in an AM or SVAM. In certain aspects an electromagnetic component can be sandwiched between two AM or SVAM layers. In a further aspect one or more of the AM or SVAM layers can be a recessed portion such that the electromagnetic component is encased in AM or SVAM. In other aspects the AM or SVAM can be manufactured so that the electromagnetic component is inserted into a cavity formed in the AM or SVAM with the insertion point being capable of being capped. In certain aspects an antenna component of a device is embedded in an AM or SVAM. The term antenna refers to a device that can transmit or receive electromagnetic waves including radio frequencies, microwave frequencies, THz frequencies, infrared, light, x-ray, etc. An antenna converts electromagnetic waves into alternating current or vice-versa. An antenna of a device can intercept electromagnetic waves and an alternating current is delivered to the device, similarly an antenna can convert alternating current from a device to an electromagnetic wave.

Certain embodiments are directed to AM or SVAM that are broadband working from DC up to a cutoff where the structure becomes resonant. The AM or SVAM compositions described herein are used to sculpt the field surrounding an electronic component, e.g., an antenna, a transmission line, etc., by embedding or shielding the electromagnetic component with AM or SVAM. The sculpting of the near field allows electronic components to be positioned in closer proximity while reducing detrimental effects due to field interference.

Certain embodiments are directed to an AM or SVAM comprising a high dielectric material embedded in a low dielectric material forming an anisotropic metamaterial or a spatially variant anisotropic metamaterial, or a low dielectric material embedded in a high dielectric material forming an anisotropic metamaterial or a spatially variant anisotropic metamaterial. High dielectric constant materials are those materials with a dielectric constant greater than 5. These materials include, but are not limited to $SiO_2$, $PbMgNbO_3$+$PbTiO_3$, $PbLaZrTiO_3$, $BaSrTiO_3$, $TiO_2$, $Ta_2O_5$, $CeO_2$, $BaZrTiO_3$, $Al_2O_3$, $(Bz,Ca,Sr)F_2$, and the like. Low dielectric materials are those materials with a dielectric constant less than 5. These materials include, but are not limited to polycarbonate, SiOxFy, hydrogen silsesquioxane, polysiloxane, fluropolyimide, benzo-cyclo-butane, black diamond, polyethylene, polypropylene, fluoropolymer, perylene, Dupont PTFE-based copolymer AF 2400, and the like.

Spatial variance occurs when a quantity that is measured at different spatial locations exhibits values that differ across the locations. In certain aspects the metamaterial comprises low or high dielectric substrate having a high or low dielectric material dispersed in an engineered pattern to produce a near field sculpting character. In certain aspects a SVAM comprises a plurality of channels, spaces, or lattice points that are occupied by high or low dielectric materials. The arrangement of high or low dielectric material embedded in the low or high dielectric substrate is configured to form an asymmetric unit cell that can be repeated any number times in two or three dimensions. The type and position of the high or low dielectric material within the low or high dielectric substrate is manipulated to provide varying electromagnetic permittivity, permeability, or permittivity and permeability. The geometry of the material can be calculated using appropriate algorithms to produce a particular manipulation of the near field, e.g., plane wave expansion method, etc. The spatial variation of the material is used to alter or sculpt near electric, magnetic, or magnetic and electric fields.

In certain aspects a view of the x-y plane of an AM or SVAM described herein produces an array of geometric shapes. In certain aspects the two-dimensional pattern of geometric shapes can comprise triangles, circles, ovals, rectangles, squares, pentagons, hexagons, or various other polygons. In certain aspects the two dimension structure comprises circles, squares, or hexagons of high dielectric material. This two-dimensional array can be varied in three dimensions to form an engineered AM or SVAM having the appropriate permittivity and/or permeability characteristics.

For example, one embodiment comprises a device having one or more electromagnetic components embedded in an anisotropic metamaterial (AM) comprising an array of asymmetric unit cells comprising a substrate forming a plurality of channels or spaces having at least one material with different electromagnetic properties included in the channels or spaces in the first material forming an anisotropic metamaterial.

In another embodiment, the anisotropic metamaterial is a spatially variant anisotropic material (SVAM). In another embodiment, the high dielectric material is a metal oxide. In another embodiment, the metal oxide is a titanium dioxide. In another embodiment, the low dielectric material is a thermoplastic. In another embodiment, the thermoplastic is polycarbonate. In another embodiment, the channels or spaces have a size small enough to be nonresonant with a wavelength of electromagnetic wave utilized by the electronic component embedded in the SVAM. In another embodiment, the AM has a lattice spacing of less than $\lambda/4$. In another embodiment, the electronic component is an antenna. In another embodiment, the antenna is an inverted F antenna (IFA). In another embodiment, the electronic component is a transmission line. In another embodiment, the AM is an all-dielectric AM.

In another embodiment a method for sculpting near electromagnetic field surrounding an electronic component using spatially variant anisotropic metamaterial comprises embedding the electronic component in a spatially variant anisotropic metamaterial, orienting anisotropy of the metamaterial around the device to sculpt near electromagnetic field surrounding the electronic component to render the electronic component compatible with a second or more electronic component(s). In another embodiment, one electronic component is an antenna. In another embodiment, the sculpting of near electromagnetic field is used to couple two or more electronic components. In another embodiment, the method further comprises sculpting near electromagnetic fields of two or more electromagnetic components, wherein the near electromagnetic fields are compatible in close proximity.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of the specification embodiments presented herein.

FIG. 1(*b*) illustrates numerical results for the scalar potential function V(x,y) surrounding the same microstrip in accordance with an embodiment of the invention;

FIG. 1(*c*) illustrates numerical results for an ordinary microstrip electric field E(x,y) in accordance with an embodiment of the invention;

FIG. 1(*d*) illustrates numerical results for an ordinary microstrip transmission line parameters in accordance with an embodiment of the invention:

FIG. 2(*b*) illustrates the effect of the strength of anisotropy of a surrounding medium for a microstrip embedded in an anisotropic medium with $\Delta\in=8.0$ in accordance with an embodiment of the invention;

FIG. 2(*c*) illustrates the effect of the strength of anisotropy of a surrounding medium for a microstrip embedded in an anisotropic medium with $\Delta\in=28.0$ in accordance with an embodiment of the invention;

FIG. 2(*d*) illustrates the effect of the strength of anisotropy of a surrounding medium for a microstrip embedded in an anisotropic medium with $\Delta\in=68.0$.

FIG. 3(*b*) illustrates the effect of spatially varying the orientation of the anisotropy of the surrounding medium for a microstrip embedded in an anisotropic medium in accordance with an embodiment of the invention;

FIG. 3(*c*) illustrates the effect of spatially varying the orientation of the anisotropy of the surrounding for a microstrip embedded in an anisotropic medium tilted by 60° in accordance with an embodiment of the invention;

FIG. 3(*d*) illustrates the effect of spatially varying the orientation of the anisotropy of the surrounding for a microstrip embedded in a spatially variant anisotropic medium in accordance with an embodiment of the invention;

FIG. 4(*b*) illustrates a rigorous 3D simulation of a standard microstrip transmission line with a metal ball placed in close proximity without the SVAM or AM in place;

FIG. 5(*b*) illustrates a rigorous 3D simulation of a microstrip embedded in an SVAM, with a metal ball placed in close proximity in accordance with an embodiment of the invention;

DETAILED DESCRIPTION

Figure 1A:
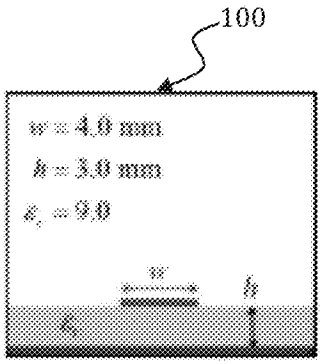
FIG. 1(*a*) illustrates the parameters for one example of an ordinary microstrip transmission line design in accordance with an embodiment of the invention.
Figure 1B:
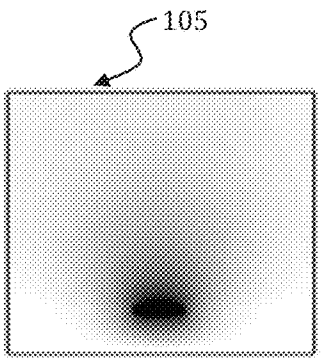
Figure 1C:
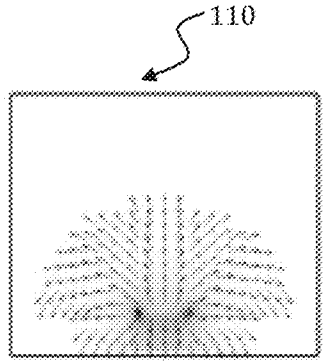
Figure 1D:
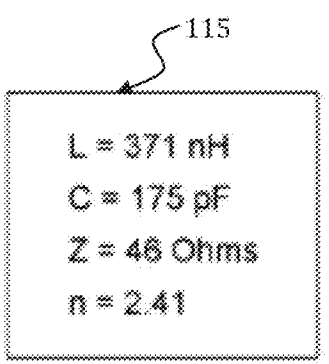

The particular values and configurations discussed in these non-limiting examples can be varied and are cited merely to illustrate at least one embodiment and are not intended to limit the scope thereof.

The use of the word "a" or "an" when used in conjunction with the term "comprising" in the claims and/or the specification may mean "one," but it is also consistent with the meaning of "one or more," "at least one," and "one or more than one."

Throughout this application, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unclaimed elements or method steps.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

Metamaterials are artificial materials engineered to have properties not found in nature. They are assemblies of multiple individual elements fashioned from conventional microscopic materials such as metals and/or plastics, but the materials are usually arranged in repeating patterns. Metamaterials gain their properties more from how they are structured than from their composition. Their shape, geometry, size, orientation, and arrangement can affect electromagnetic fields and waves (i.e. light, x-rays, microwaves, electromagnetic radiation, etc.) or sound in an unconventional manner, creating material properties that are not achievable with conventional materials.

Anisotropic Metamaterials (AMs) and/or Spatially Variant Anisotropic Metamaterials (SVAMs) can be used to mitigate problems with signal integrity, crosstalk, noise, and unintentional coupling between devices or electronic components. Anisotropic materials possess a different electromagnetic response depending on the direction of the field. In such a case, the permittivity and/or permeability are described by tensors instead of scalar quantities. Inside an anisotropic medium, the near-fields around component tend to develop in the directions with the highest constitutive parameters. This can be confined to a single direction if the anisotropy is made uniaxial. By spatially varying the orientation of the anisotropy around a device, the near field can be sculpted on a subwavelength scale. Static fields can be sculpted the same way.

The degree to which fields can be sculpted inside AMs or SVAMs depends on the strength of the anisotropy, or birefringence, and the orientation. Metamaterials are engineered composites composed of a periodic lattice of physical features that interact with the electromagnetic field to provide new and useful properties. They can provide very strong anisotropy and, combined with 3D printing, provide a mechanism for spatially varying the orientation of the anisotropy.

Metamaterials can be composed of resonant metallic elements that produce very high loss. Embodiments disclosed herein make use of a dielectric AM or SVAM designed and used in various manners. These dielectric AMs or SVAMs can be composed of very low loss materials and can be monolithic. In certain aspects, nonresonant AMs or SVAMs are used, so they are extraordinarily broadband, working from DC up to a cutoff where the structure becomes resonant. Compositions described herein are used to sculpt the field surrounding an electronic component, e.g., an antenna, a transmission line, etc., by embedding the component in an AM or SVAM.

Permittivity is the measure of the resistance that is encountered when forming an electric field in a medium. That is permittivity is a measure of how an electric field affects, and is affected by, a dielectric medium. The permittivity of a medium describes how much electric field is generated per unit charge in that medium. More electric flux exists in a medium with a high permittivity (per unit charge) because of polarization effects. Permittivity is directly related to electric susceptibility, which is a measure of how easily a dielectric polarizes in response to an electric field. Thus, permittivity relates to a material's ability to transmit (or "permit") an electric field.

Permeability can thus be thought of as a measure of the ability of a material to support the formation of a magnetic field within itself. In other words, it is the degree of magnetization that a material obtains in response to an applied magnetic field. Magnetic permeability is typically represented by the Greek letter $\mu$. In S1 units, permeability is measured in Henries per meter (H/m), or Newtons per ampere squared ($N/A^2$). The permeability constant, also known as the magnetic constant or the permeability of free space, is a measure of the amount of resistance encountered when forming a magnetic field in a classical vacuum.

In certain aspects an all-dielectric uniaxial metamaterial is designed to provide anisotropy. In one embodiment, a metamaterial comprises a square array of high dielectric constant cylinders embedded in a low dielectric constant medium. The geometry of the material can be altered to provide the appropriate characteristic to the material to produce the desired near-field shape. In one example the high dielectric material is titanium dioxide and the low dielectric material is a thermoplastic. The dimensions can be optimized to maximize the birefringence. The lattice spacing should be less than $\lambda/4$. This dimension should be made as small as possible so that the geometry of the unit cell still forms well after manufacturing. The orientation of the anisotropy can be manipulated to sculpt the near field as needed.

In order to spatially vary the orientation of unit cells throughout a lattice without changing the size and shape of the unit cells, an algorithm can be used to synthesize spatially variant lattices. The algorithm is capable of spatially varying any combination of attributes of the lattice while still rendering the overall lattice smooth and continuous. Attributes include unit cell orientation, lattice spacing, fill fraction, material composition, geometry, and more. Avoiding discontinuities can be useful because these discontinuities can cause scattering, field concentrations, and other detrimental effects.

In one embodiment, an AM or SVAM can be manufactured by 3D printing. Three-dimensional (3D) printing refers to processes that create 3D objects based on digital 3D object models and one or more materials dispenser. In 3D printing, a dispenser moves in at least two dimensions and dispenses material according to a determined print pattern. To build a 3D object, a platform that holds the object being printed is adjusted such that the dispenser is able to apply many layers of material—a 3D object may be printed by printing many layers of material, one layer at a time. In certain aspects a technique called fused deposition modeling (FDM) can be used. In this process, an inexpensive thermoplastic filament is fed through a print head where it is melted and deposited onto the surface of a platform. The print head is translated across the platform to deposit a layer of material in the desired pattern. After the layer is printed, the platform is lowered and the next layer is printed on top of the previous. This process is repeated for all layers until the part is complete.

A device's geometry can be generated from a spatial map of the electromagnetic fields. Additional information needed to accomplish this may include lookup tables that quantify the effective properties of different metamaterial unit cells as a function of their structural parameters. Given this information, the geometry of the metamaterial at each point in the lattice can be determined and a synthesis tool can then generate a smooth and continuous lattice with the prescribed spatial variance. This is particularly powerful and useful for devices with complex geometries.

The following examples as well as the figures are included to demonstrate preferred embodiments of the invention. It should be appreciated by those of skill in the art that the techniques disclosed in the examples or figures represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Embedding a Transmission Line

Figure 11:
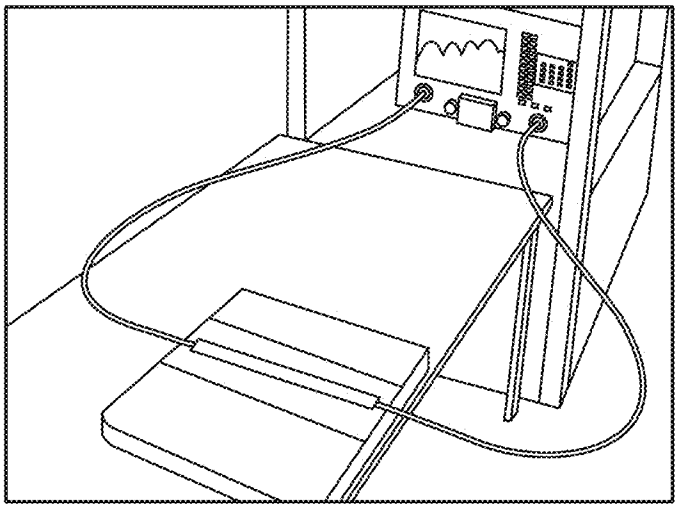
FIG. 11. Illustrates a microstrip transmission line, with and without the SVAM in place in accordance with an embodiment of the invention.
Figure 11:
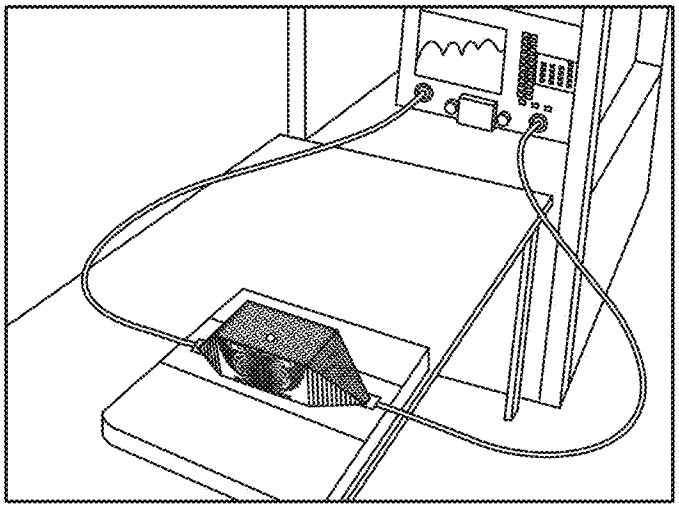

To test a SVAM, a microstrip transmission line is designed specifically to be placed under an SVAM. The width of the line is selected to be large relative to the periodic structure of the metamaterial. For example it can be made to be 10 mm so that it is large relative to the periodic structure of the metamaterial. The SVAMs can be 3D printed with much finer dimensions so they can function around transmission lines having more typical dimensions. The microstrip can be placed onto a substrate that may be selected according to design considerations but is, for example 2.8 mm thick. A ground plane can be placed under the substrate. Illustration 1100 of the microstrip with the SVAM in place is shown next to illustration 1105 which shows the microstrip without the SVAM in place in FIG. 11.

Figure 12:
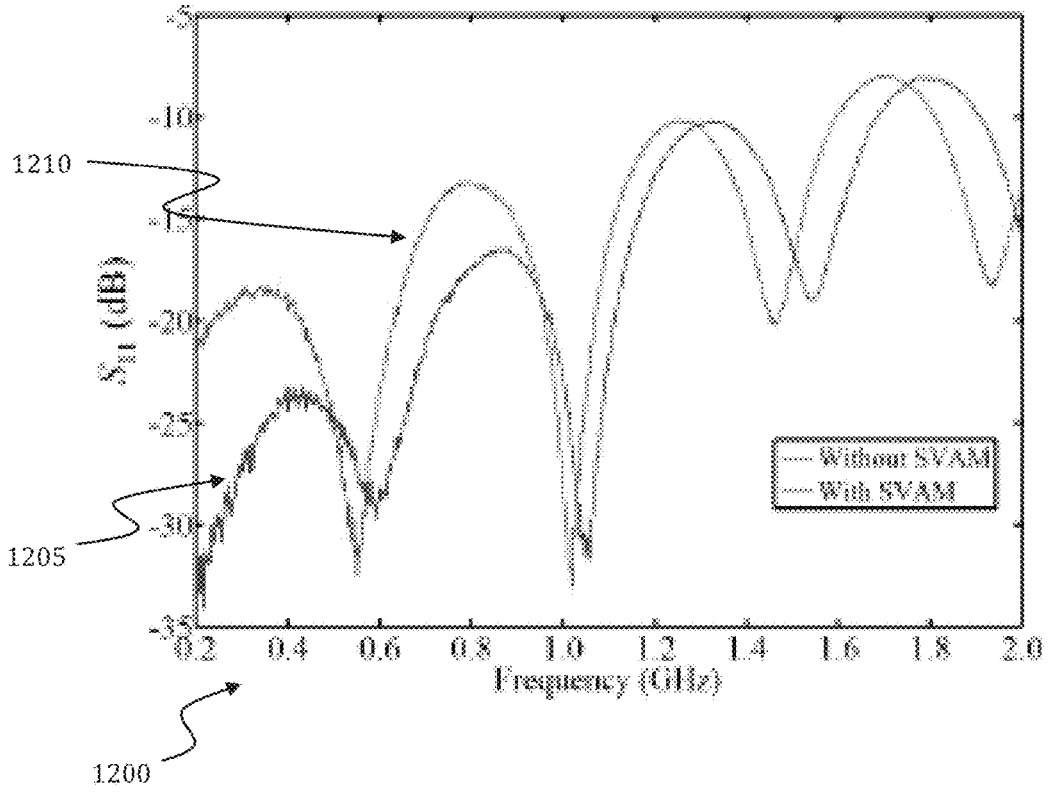
FIG. 12 illustrates a chart of reflection from a bare microstrip, with and without the SVAM in place in accordance with an embodiment of the invention.

The scattering parameters from the transmission line were measured using an Agilent N5245 PNA-X vector network analyzer. The data is shown in chart 1200 shown in FIG. 12. Little was done to match impedance so the return loss from the bare microstrip averaged around minus 15 dB. The dips in this spectrum arise from the Fabry-Perot resonance established between the connectors at either end of the line. When the SVAM was inserted as shown by trace 1210 (as opposed to trace 1205 without the SVAM), the spectrum shifted and reflection dropped by around 4 dB on the low frequency side. It is important to note that this data only shows the background reflection from the bare microstrip and SVAM. No metal ball was involved in these measurements.

Figure 13:
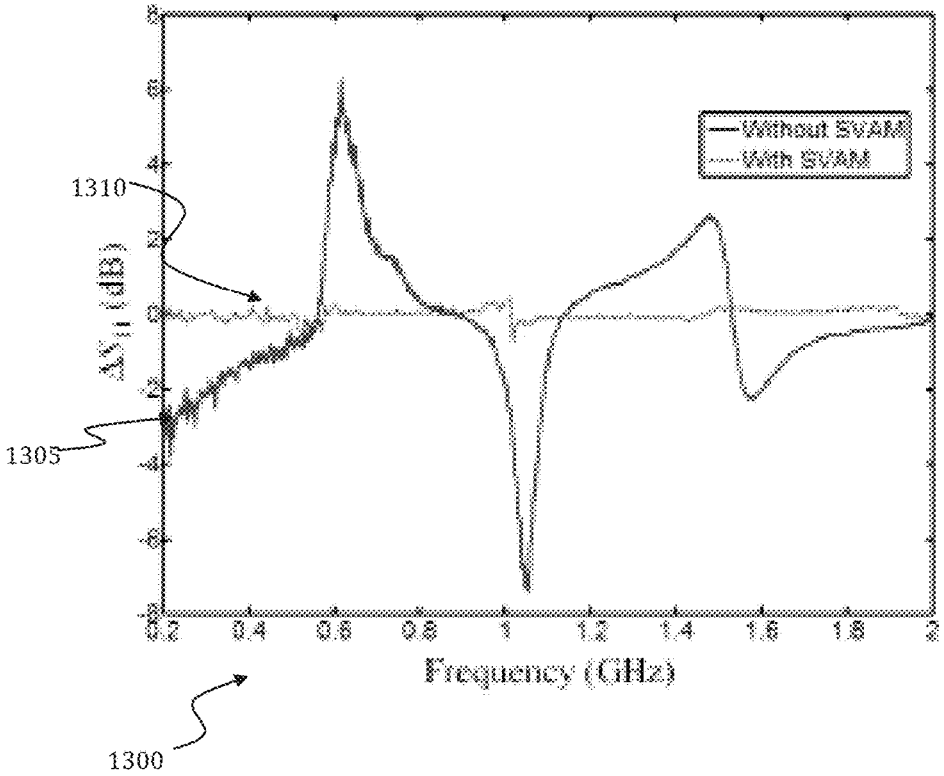
FIG. 13 illustrates a change in S11 as ball is placed and removed for two cases in accordance with an embodiment of the invention.

From here, the scattering parameters of the bare microstrip were measured with and without the metal ball in place. The return loss of the microstrip and the insertion loss of the SVAM itself were calibrated out of the measurements so that only the effects of the metal ball were measured. The resulting change in S11, with and without the ball in place, is plotted in trace 1305 in chart 1300 in FIG. 13. Fluctuations approaching 7 dB were measured. This same procedure was repeated, but with the SVAM in place as shown by trace 1310. The change in S11 is plotted in FIG. 13. For the second case, virtually no change in S11 was detected because the SVAM sculpted the field away from the ball. Fluctuations in this second curve were less than 0.5 dB.

The impact of the strength of the anisotropy as well as spatially varying the orientation of the anisotropy was evaluated. Based on these findings, the inventors demonstrate the concept of sculpting the field by decoupling a microstrip transmission line from a metal object placed in close proximity by embedding the transmission line in a SVAM.

The fundamental mode in a microstrip transmission line is very close to TEM (transverse electromagnetic). In this case, the analysis reduces to an electrostatic problem and transmission lines can be modeled using the inhomogeneous Laplace's equation instead of the more rigorous wave equation. The inventors start with Maxwell's divergence equation, the constitutive relation for the electric field in an anisotropic material, and the relation between the electric field and the scalar potential. These are expression in the plane that is the cross section of the transmission line.

$$\begin{bmatrix} \frac{\partial}{\partial x} & \frac{\partial}{\partial y} \end{bmatrix} \begin{bmatrix} D_x(x, y) \\ D_y(x, y) \end{bmatrix} = 0 \tag{1}$$

$$\begin{bmatrix} D_x(x, y) \\ D_y(x, y) \end{bmatrix} = \varepsilon_0 \begin{bmatrix} \varepsilon_{xx}(x, y) & \varepsilon_{xy}(x, y) \\ \varepsilon_{yx}(x, y) & \varepsilon_{yy}(x, y) \end{bmatrix} \begin{bmatrix} E_x(x, y) \\ E_y(x, y) \end{bmatrix} \tag{2}$$

$$\begin{bmatrix} E_x(x, y) \\ E_y(x, y) \end{bmatrix} = -\begin{bmatrix} \partial/\partial x \\ \partial/\partial y \end{bmatrix} V(x, y) \tag{3}$$

The inhomogeneous Laplace's equation is derived by substituting Equation (2) into Equation (1) to eliminate the D field, and then substituting Equation (3) into this new expression to eliminate the E field.

$$\begin{bmatrix} \frac{\partial}{\partial x} & \frac{\partial}{\partial y} \end{bmatrix} \begin{bmatrix} \varepsilon_{xx}(x, y) & \varepsilon_{xy}(x, y) \\ \varepsilon_{yx}(x, y) & \varepsilon_{yy}(x, y) \end{bmatrix} \begin{bmatrix} \partial/\partial x \\ \partial/\partial y \end{bmatrix} V(x, y) = 0 \tag{4}$$

Given a solution to this equation, the E field can be computed using Equation (3) and then the D field computed using Equation (2). At this point, all of the fields surrounding the device are known, can be visualized, and can be used to calculate the transmission line parameters. First, the distributed capacitance C of the line is calculated by looking at it as a capacitor. Given the electric fields, the total energy U stored in this system is $$U = \frac{1}{2} \iint_A (\vec{D} \cdot \vec{E}) dx dy. \tag{5}$$

This integral is taken over the entire cross section of the transmission line and must encompass all of the field energy. The energy stored in a capacitor is related to its capacitance C and stored voltage $V_0$ through Equation (6).

$$U = CV_0^2/2 \tag{6}$$

Combining Equations (5) and (6) gives us an equation to calculate the distributed capacitance from the electric fields.

$$C = \frac{1}{V_0^2} \iint_A (\vec{D} \cdot \vec{E}) dx dy \tag{7}$$

Second, if the medium surrounding the transmission line has no magnetic response, we can calculate the distributed inductance L directly from the distributed capacitance $C_{air}$ of the same transmission line embedded in air instead of the anisotropic dielectric. In this case, the velocity of the wave on the line is related to the transmission line parameters through $C_0 \approx 1/(LC_{air})$. Solving this for L yields $$L = 1/c_0^2 C_{air}) \tag{8}$$

Given the distributed inductance and capacitance, the characteristic impedance of the transmission line is:

$$Z_0 = \sqrt{(L/C)} \tag{9}$$

The propagation constant at frequency ω is:

$$\beta = \omega\sqrt{(L/C)} \tag{10}$$

The remaining challenge is obtaining the solution to Equation (4). This can be obtained using a simple finite-difference method. This approach approximates the derivatives using central finite-differences. To handle this in a straightforward manner, we staggered the position of Ex, Ey, and V across a two-dimensional (2D) grid. The potential is located at the origin of each cell in the grid. The electric fields are positioned at the cell boundaries, but offset from the origin by a half cell. After approximating the derivatives with finite-difference, each of Equations (1)-(3) are written once for every cell in the grid. Adopting the matrix operators these large sets of equations can be written in block matrix form as $$\begin{bmatrix} D_x & D_y \end{bmatrix} \begin{bmatrix} d_x \\ d_y \end{bmatrix} = 0. \tag{11}$$

$$\begin{bmatrix} d_x \\ d_y \end{bmatrix} = \begin{bmatrix} \varepsilon_{xx} & R\varepsilon_{xy} \\ R^T\varepsilon_{yx} & \varepsilon_{yy} \end{bmatrix} \begin{bmatrix} e_x \\ e_y \end{bmatrix} \tag{12}$$

$$\begin{bmatrix} e_x \\ e_y \end{bmatrix} = -\begin{bmatrix} D_x^T \\ D_y^T \end{bmatrix} v \tag{13}$$

Here, Dx and Dy are banded matrices that calculate spatial derivatives of the electric fields across the staggered grid. The 'T' superscript indicates a transpose operation. The terms $\in_{ss}$, $\in_{xy}$, $\in_{yx}$, and $\in_{yy}$ are diagonal matrices containing the permittivity functions across the grid. The functions $\in_{xx}$ and $\in_{yx}$ are defined to be at the same points as $E_x$ while the functions $\in_{xy}$ and $\in_{yy}$ are defined at the same points as $E_y$. R is a banded matrix that interpolates the $E_y$ quantities to be at the same positions as the Ex quantities. RT is the transpose of R and interpolates $E_x$ quantities to be at the same positions as the $E_y$ quantities. The terms $d_x$, $d_y$, $e_x$ and $e_y$ are column vectors containing the field components $D_x$, $D_y$, $E_x$, and $E_y$ respectively throughout the grid. Lastly, v is a column vector containing the scalar potential V throughout the grid. The matrix form of Equation (4) is derived by substituting Equation (12) into Equation (11) to eliminate $d_x$ and $d_y$, and then using Equation (13) to eliminate $e_x$ and $e_y$. The resulting block matrix equation can be written as:

$$Lv = 0 \tag{14}$$

$$L = [D_x \quad D_y]\begin{bmatrix} \varepsilon_{xx} & R\varepsilon_{xy} \\ R^T\varepsilon_{yx} & \varepsilon_{yy} \end{bmatrix}\begin{bmatrix} D_x^T \\ D_y^T \end{bmatrix} \tag{15}$$

Equation (14) has only a trivial solution because the potential applied to the conductors has not been defined yet. To do this, a diagonal matrix F is constructed which has 1's in the diagonal positions corresponding to where conductors are placed on the grid. 0's are placed everywhere else. Further a column vector $v_f$ which contains the voltages applied to each of the conductors identified in F, is constructed. Given these, Equation (14) is modified according to $$L'v=b \tag{16}$$

$$L'=F+(I-F)L \tag{17}$$

$$b=Fv_f \tag{18}$$

Now Equation (16) can be numerically solved as $v=(L')^{-1}b$. Given v, the E field components are calculated using Equation (13) and then the D field components calculated using Equation (12). After these functions are obtained, the distributed capacitance is calculated according to Equation (19).

$$C = \frac{\varepsilon_0 \cdot \Delta x \cdot \Delta y}{V_0^2}[d_x \quad d_y]\begin{bmatrix} e_x \\ e_y \end{bmatrix} \tag{19}$$

The free space permittivity so was removed from Equation (12) and inserted here for convenience. The entire solution process is repeated with the dielectric set to air. In this case, Equation (15) reduces to the homogeneous Laplace's equation.

$$L_h = [D_x \quad D_y]\begin{bmatrix} D_x^T \\ D_y^T \end{bmatrix} \tag{20}$$

From this, the distributed inductance L is calculated from the distributed capacitance $C_{air}$ using Equation (8). Finally, the characteristic impedance and propagation constant are calculated using Equations (9) and (10), respectively.

To demonstrate and benchmark the method described above, an ordinary microstrip transmission line was analyzed. The baseline design was obtained from the closed form expression known in the art. The width of the microstrip was w=4.0 mm, thickness of the substrate was h=3.0 mm, and the dielectric constant of the substrate was er=9.0. The impedance calculated analytically using these dimensions was 49Ω.

Design of the Uniaxial Metamaterial. An all-dielectric uniaxial metamaterial was designed to provide the required anisotropy. It was a square array of high dielectric constant cylinders embedded in a low dielectric constant medium. This geometry was chosen because it is known to provide stronger anisotropy. The SVAM example is composed of polycarbonate (PC) thermoplastic backfilled with titanium dioxide (TiO2) nano-powder. The dielectric constant of the PC was measured to be 2.33. The dielectric constant of the TiO2 powder was estimated to be 40 using the Bruggeman model and assuming the packing density was 64% by volume. Based on these dielectric constants, the dielectric tensor can be quickly estimated using the Weiner bounds.

$$[\varepsilon_r] = \begin{bmatrix} \varepsilon_{xx} & 0 & 0 \\ 0 & \varepsilon_{yy} & 0 \\ 0 & 0 & \varepsilon_{zz} \end{bmatrix} \tag{21}$$

$$\frac{1}{\varepsilon_{xx}} = \frac{1}{\varepsilon_{zz}} = \frac{f_o}{\varepsilon_{r1}} + \frac{1-f_o}{\varepsilon_{r2}} \tag{22}$$

$$\in_{yy}=f_{\in}\in_{r1}+(1-f_{\in})\in_{r2} \tag{23}$$

Figure 6:
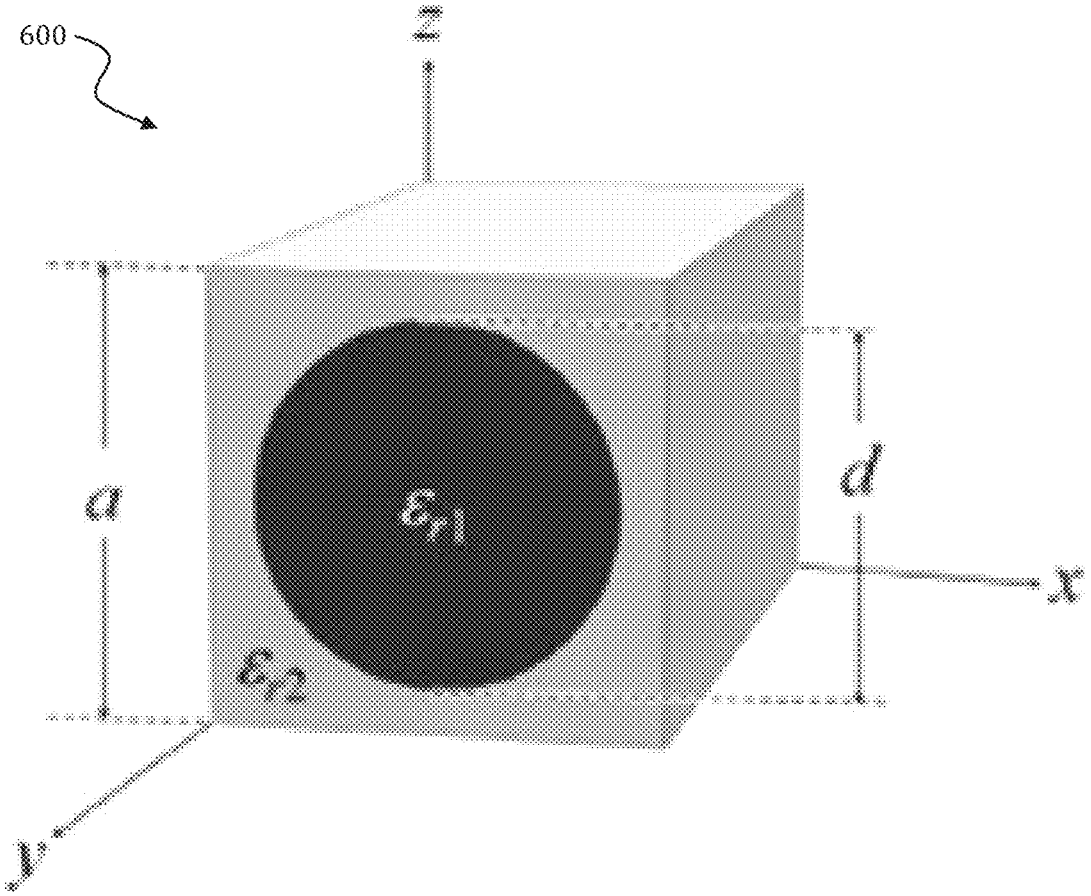
FIG. 6 illustrates a cross-section of a unit cell for er1=40 and er2=2.33, and optimized dimensions of d/a=0.8 in accordance with an embodiment of the invention.

With optimized dimensions, the weight terms in the above equations are $f_0 \approx 0.72$ and $f_e \cong 0.72$ and we get $\in_{xx}=7.24$ and $e_{yy}=24.55$. Rigorous values were obtained by modeling the unit cell with the plane wave expansion method (PWEM). Using the PWEM, the dimensions were optimized to maximize the birefringence. The lattice spacing should be less than λ/4. In practice, this dimension should be made as small as possible so that the geometry of the unit cell still forms well after manufacturing. The optimum diameter of the cylinder was found to be d=0.84a. This result is valid and robust to the choice of $\in_{r1}$ and $\in_{r2}$. The resulting unit cell 600, shown in FIG. 6, was predicted to have $\in_{xx}=7.29$ and $\in_{yy}=24.15$.

Figure 7:
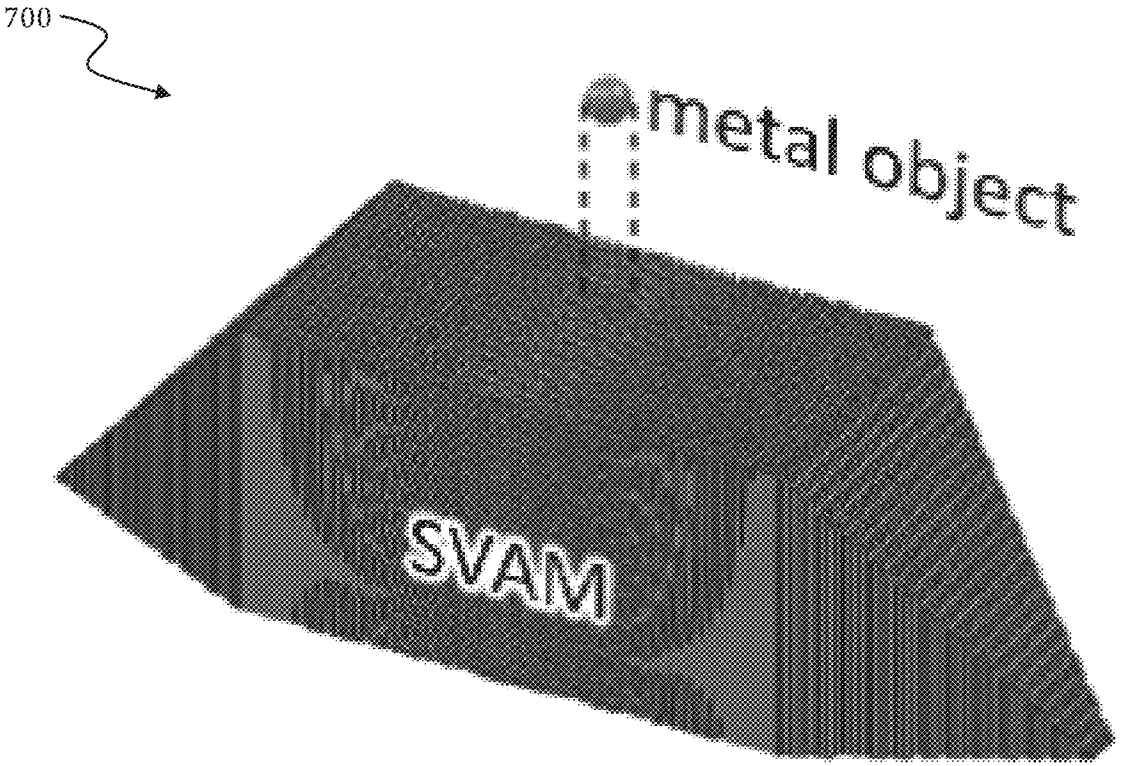
FIG. 7 illustrates an SVAM to be placed on top of an otherwise ordinary microstrip in accordance with an embodiment of the invention.

Design of the Spatial Variance. The SVAM was designed so that it could be placed on top of an otherwise ordinary microstrip. It was tapered at either end of the device to provide a smoother transition of impedance from the bare microstrip into the SVAM region. A small hole was formed through the device so that a metal ball could be inserted and located to within 2 mm of the microstrip. An SVAM 700 is shown in FIG. 7.

Figure 8:
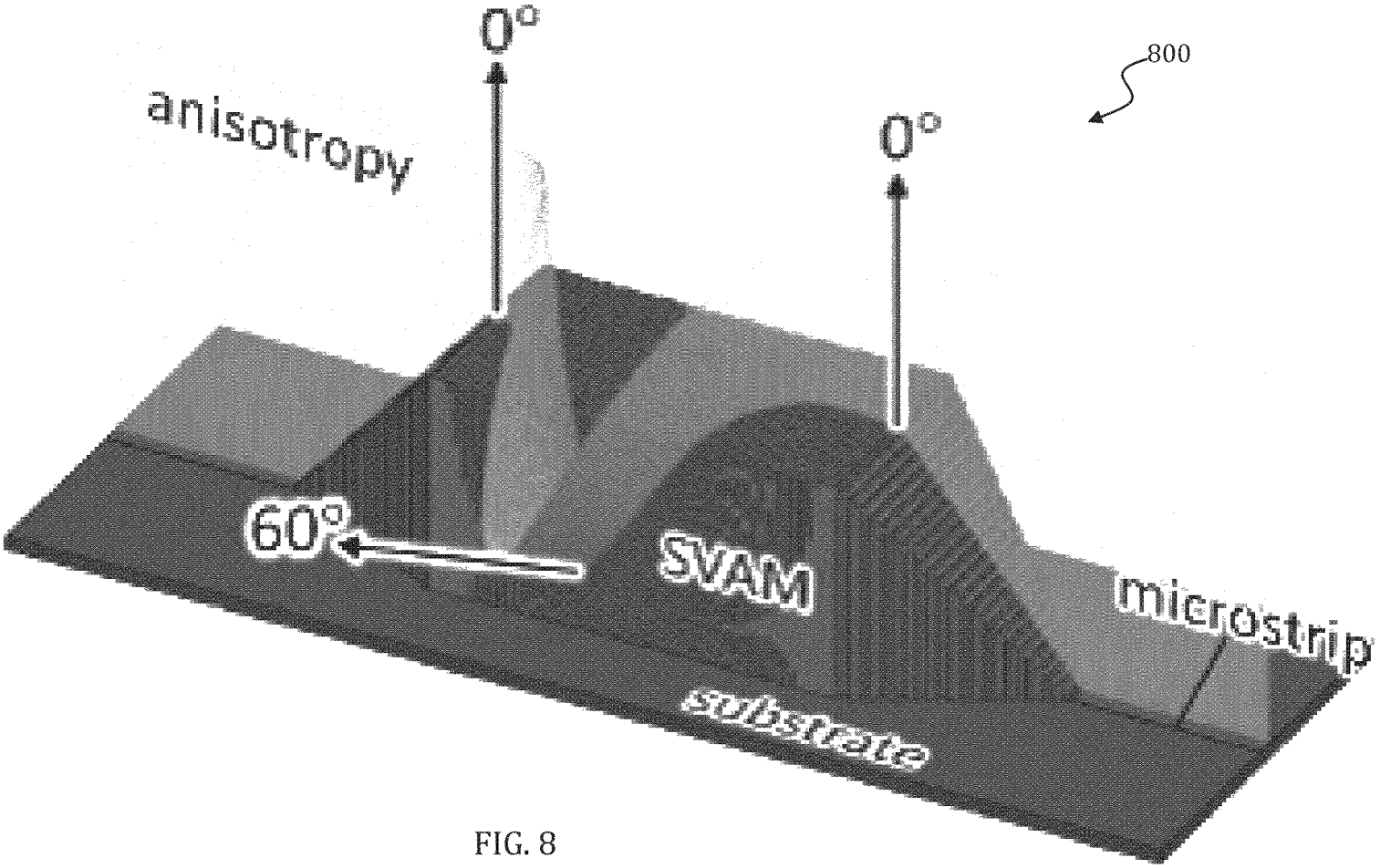
FIG. 8 illustrates orientation of the anisotropy of an SVAM in accordance with an embodiment of the invention.

With the cylinders oriented vertically, the near-field around the line would develop vertically, like that shown in FIG. 3(*b*). To move the field away from the ball, the cylinders were tilted away from the ball to an angle of 60° following a Gaussian profile. The device and the change in the orientation of the anisotropy are illustrated in model 800 shown in FIG. 8. For this design, it was not necessary to employ a more sophisticated design technique like transformation optics, but it is possible to do so.

In order to spatially vary the orientation of the unit cells throughout a lattice without changing the size and shape of the unit cells, a novel algorithm was used to synthesize spatially variant lattices. The algorithm is capable of spatially varying any combination of attributes of the lattice while still rendering the overall lattice smooth and continuous. Attributes include unit cell orientation, lattice spacing, fill fraction, material composition, geometry, and more. Avoiding discontinuities is important because these can cause scattering, field concentrations, and other detrimental effects.

Figure 9:
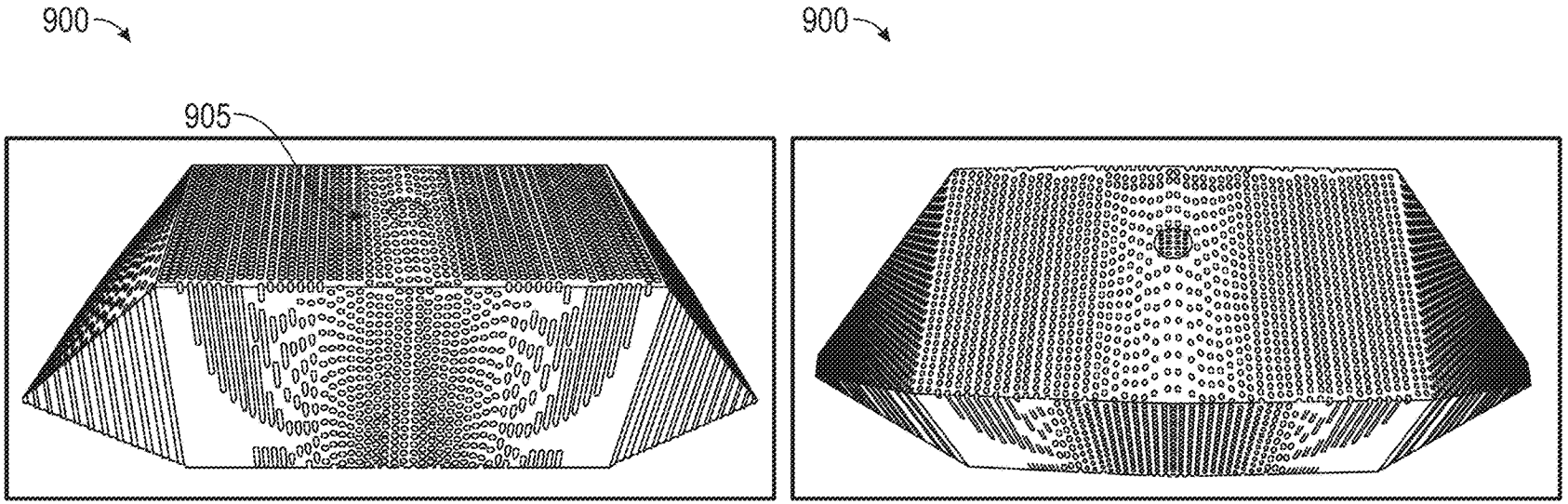
FIG. 9 illustrates a 3D printed spatially variant anisotropic metamaterial in accordance with an embodiment of the invention.

Device Manufacturing. One embodiment of a SVAM was manufactured by 3D printing using a technique called fused deposition modeling (FDM). In this process, an inexpensive thermoplastic filament is fed through a print head where it is melted and deposited onto the surface of a platform. The print head is translated across the platform to deposit a layer of material in the desired pattern. After the layer is printed, the platform is lowered and the next layer is printed on top of the previous. This process is repeated for all layers until the part is complete. Several small test samples were printed to assess the minimum diameter of the holes so that they would form well in the final device. This was determined to be 2.0 mm. One embodiment of a finished device 900 is shown in FIG. 9. In this device, the density of the holes 905 is uniform. The density of the holes appears different throughout the device only because their orientation has been spatially varied and the device is shown from two different perspectives.

Figure 10:
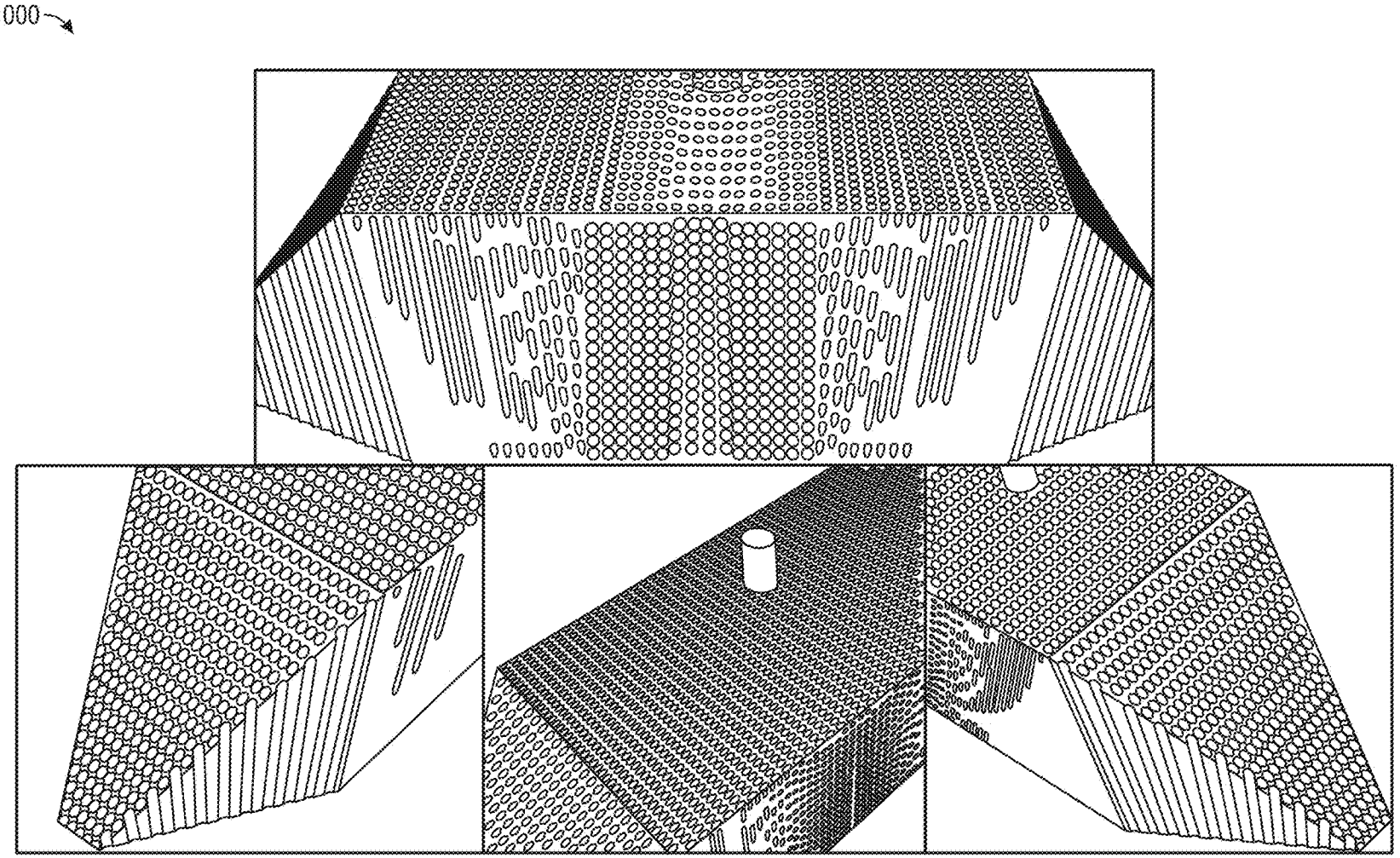
FIG. 10. Illustrates an SVAM packed with TiO2 powder in accordance with an embodiment of the invention.

Next, the holes were packed with the $TiO_2$ nano-powder. First, a long wavelength vibrating table was used to shake the powder down into the holes. This achieved about a 95% fill. Second, the device was placed in an ultrasonicator to densify the powder. The remaining voids where filled by hand and then the device was placed back into the ultrasonicator. Embodiments of the packed SVAM 1000 are shown in FIG. 10. The long-term vision for this technology is to manufacture the entire circuit and SVAM completely by 3D printing. At present, no high dielectric constant material is commercially available for 3D printing so the $TiO_2$ powder was used instead.

Transformation optics calculates only material properties, whereas the SV tool calculates the actual geometry that can be directly fabricated. From this perspective, hybridizing the two methods will provide a single tool that can generate a device's geometry directly from a spatial map of the electromagnetic fields. Additional information needed to accomplish this includes lookup tables that quantify the effective properties of different metamaterial unit cells as a function of their structural parameters. Given this information, the geometry of the metamaterial at each point in the lattice can be determined and the synthesis tool can then generate a smooth and continuous lattice with the prescribed spatial variance. This will be particularly powerful and useful for devices with complex geometries.

Figures 2A, 2B, 2C, 2D:
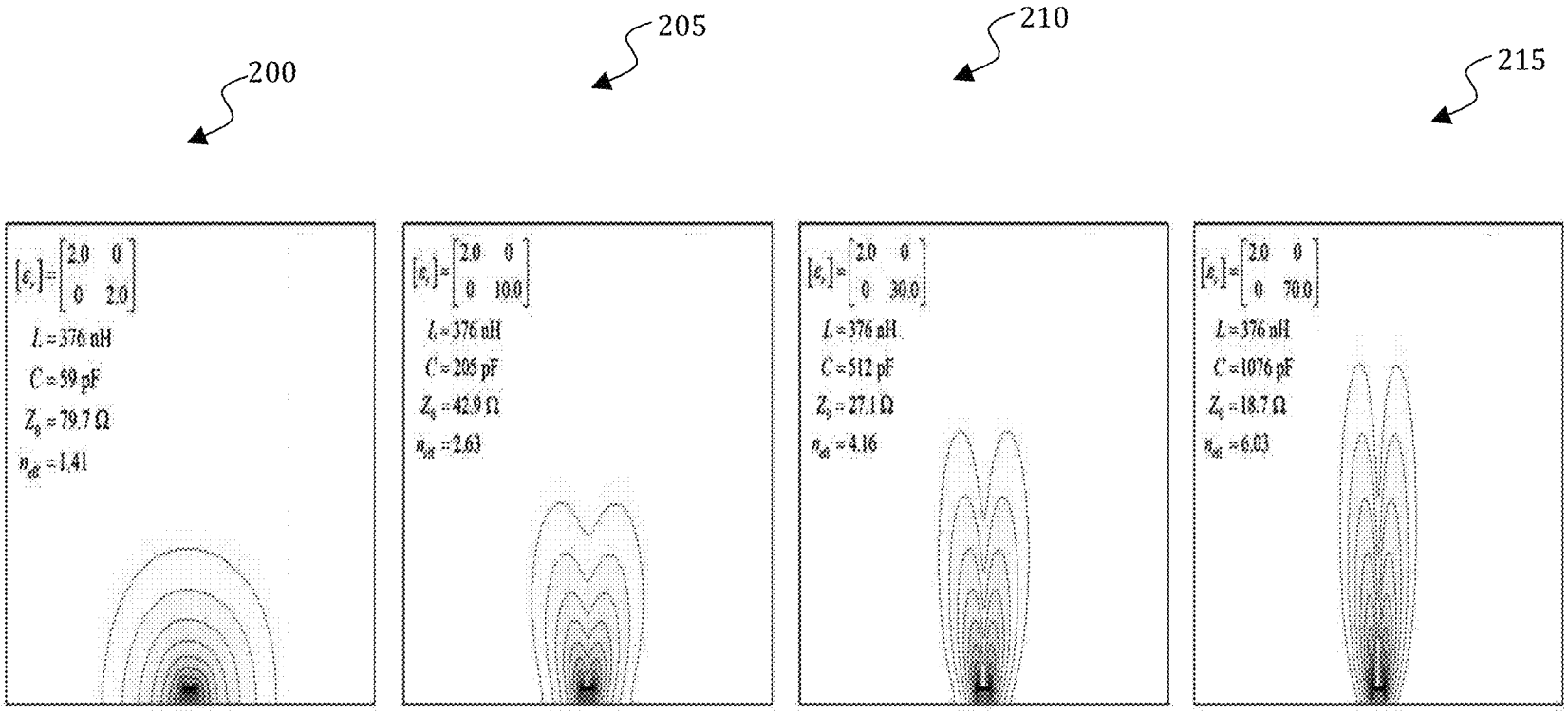
FIG. 2(*a*) illustrates the effect of the strength of anisotropy of the surrounding medium for a microstrip embedded in an isotropic medium in accordance with an embodiment of the invention.

Microstrip Embedded In Anisotropic Media. Numerical results for an ordinary microstrip are illustrated in FIGS. 1*a-d*. FIG. 1(*a*) shows a chart 100 illustrating results for an ordinary microstrip design. FIG. 1(*b*) shows chart 105 illustrating results for the electric scalar potential function V(x, y) and FIG. 1(*c*) shows chart 110 for an electric field E(x,y). FIG. 1(*d*) shows a chart 115 associated with transmission line parameters. A microstrip embedded in anisotropic media was explored. First, a series of simulations was performed to study the effect of the strength of the anisotropy, or birefringence, of the dielectric medium. Birefringence is defined as $\Delta\in=\in_{xx}-\in_{yy}$, when the crystal axes are chosen so that the tensor is diagonal. The results of this analysis are provided in FIGS. 2(*a*)-(*d*). FIG. 2(*a*) shows a chart 200 associated with a microstrip embedded in an isotropic medium. FIG. 2(*b*) shows a chart 205 associated with a microstrip embedded in an anisotropic medium with $\Delta\in=8.0$. FIG. 2(*c*) shows a chart 210 of a microstrip embedded in an anisotropic medium with $\Delta\in=28.0$. FIG. 2(*d*) illustrates a chart 215 of a microstrip embedded in an anisotropic medium with $\Delta\in=68.0$. The distributed inductance was not affected because the electrostatic approximation decouples the magnetic field from the electric field. The distributed capacitance increased as the dielectric constant of the $\in_{yy}$ tensor element was increased. This lowered the impedance of the transmission line as expected from Equation (9). The shape of the field was also affected by the increasing anisotropy. After observing the trend in FIGS. 2(*a*)-(*d*), it can be concluded that the field does tend to develop along the axis with the highest dielectric constant. Here, the field developed more strongly in the vertical direction because $\in_{yy}>\in_{xx}$. The degree to which this occurs was observed to be proportional to the birefringence.

Figures 3A, 3B, 3C, 3D:
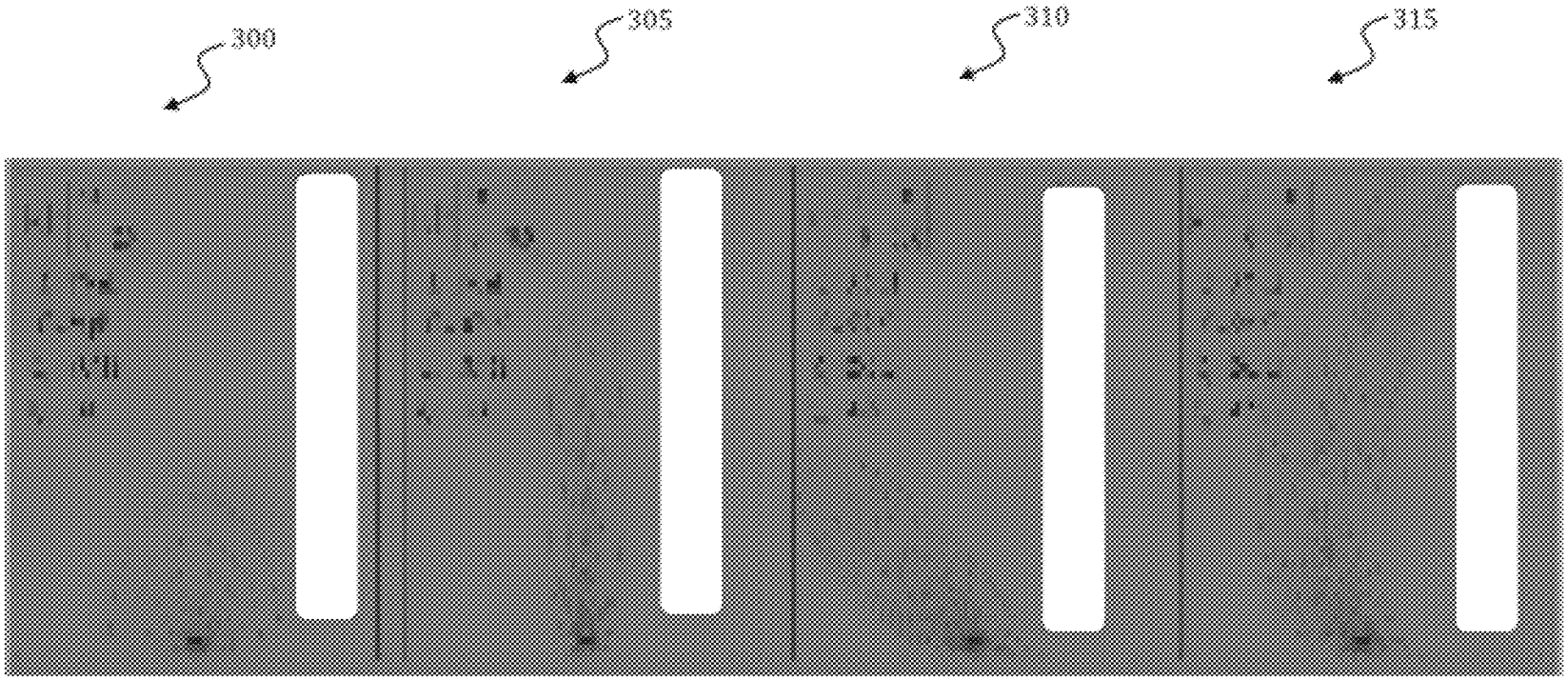
FIG. 3(*a*) illustrates the effect of spatially varying the orientation of the anisotropy of the surrounding medium for a microstrip embedded in an isotropic medium in accordance with an embodiment of the invention.

Next, the effect of spatially varying the orientation of the anisotropy was studied in a series of simulations summarized in FIG. 3. FIG. 3(*a*) illustrates a chart 300 associated with a microstrip embedded in an isotropic medium. FIG. 3(*b*) illustrates a chart 305 associated with a microstrip embedded in an anisotropic medium. FIG. 3(*c*) illustrates a chart 310 associated with a microstrip embedded in an anisotropic medium tilted by 60°. FIG. 3(*d*) illustrates a chart 315 associated with a microstrip embedded in a spatially variant anisotropic medium. The first device is the same microstrip modeled previously, but with the dielectric constant set to 2.0. The second device was a transmission line embedded in an anisotropic medium with $\in_{xx}=2.0$ and $\in_{yy}=70.0$. The impedance of the line changed significantly after embedding in a SVAM so we conclude that transmission lines must be designed to be embedded. The shape of the field responded consistent with the discussion around FIG. 2. For the third device shown in FIG. 3C, the orientation of the anisotropy around the transmission line was tilted to the left by 60°. Consistent with the discussion above, the field shifted in this new direction. The impedance of the line increased somewhat due to the tilt. In the final device shown in FIG. 3D, the orientation of the anisotropy was spatially varied and the field still followed the anisotropy through the spatial variance. The impedance of this line changed only very slightly. This suggests that after a device is designed to be embedded in an anisotropic medium, the near-field can be arbitrarily sculpted using spatially variant anisotropy with minimal impact on the properties of the line.

Figure 4A:
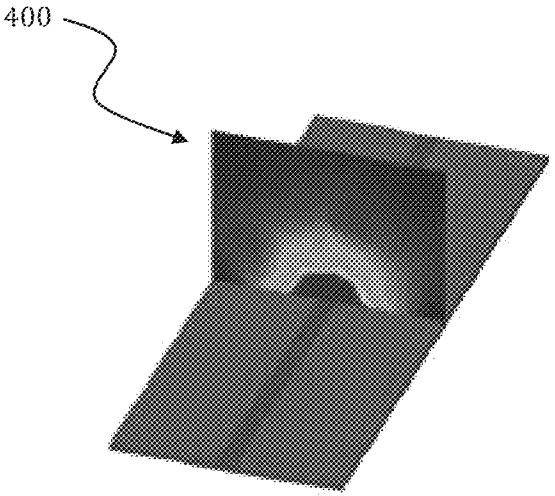
FIG. 4(*a*) illustrates a rigorous 3D simulation of standard microstrip transmission line without a metal ball placed in close proximity and without the SVAM or AM in place.
Figure 4B:
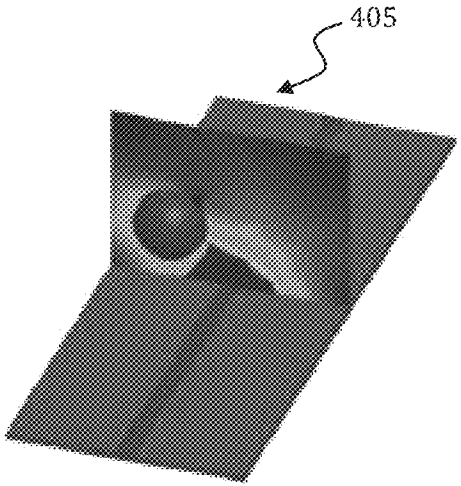

To prove the concept in a more rigorous manner, a series of simulations was performed using Ansys HFSS, which is a 3D full-wave electromagnetic field solver. A standard 50Ω microstrip transmission line was designed on Rogers RT/Duroid®. The line was simulated with a metal ball in close proximity in cross section 400 and without a metal ball placed in close proximity in cross section 405. Cross sections of the field from these simulations are shown in FIG. 4. These show that the near-field of the transmission line shifts toward the metal ball when it is introduced.

Figure 5B:
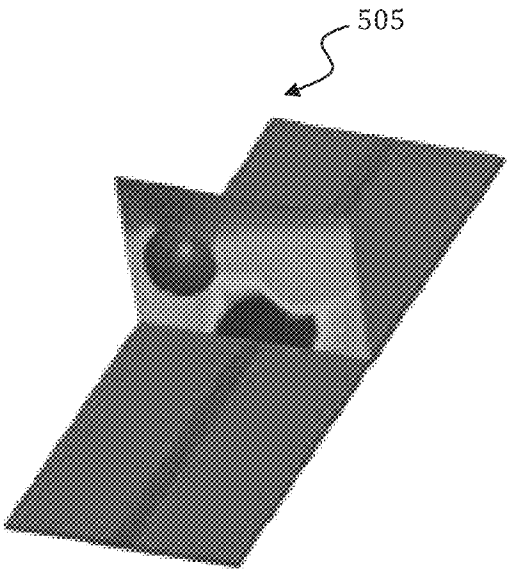
FIG. 5(*a*) illustrates a rigorous 3D simulation of a microstrip embedded in an SVAM, without a metal ball placed in close proximity in accordance with an embodiment of the invention.
Figure 5A:
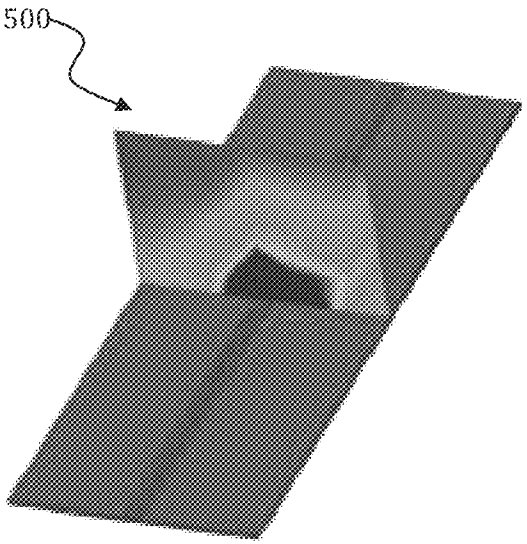

Next, the microstrip was embedded in a SVAM where the anisotropy was rotated from the surface normal by 60° away from the metal ball. This was done to shift the field away from the ball so that its presence would not be felt by the microstrip. Cross sections 500 and 505 of the field from these simulations are shown in FIG. 5. In this case, the presence of the ball had much less effect on the shape of the near field, confirming the concept described herein.

Example 2—Embedding of Inverted F Antenna

Figure 14:
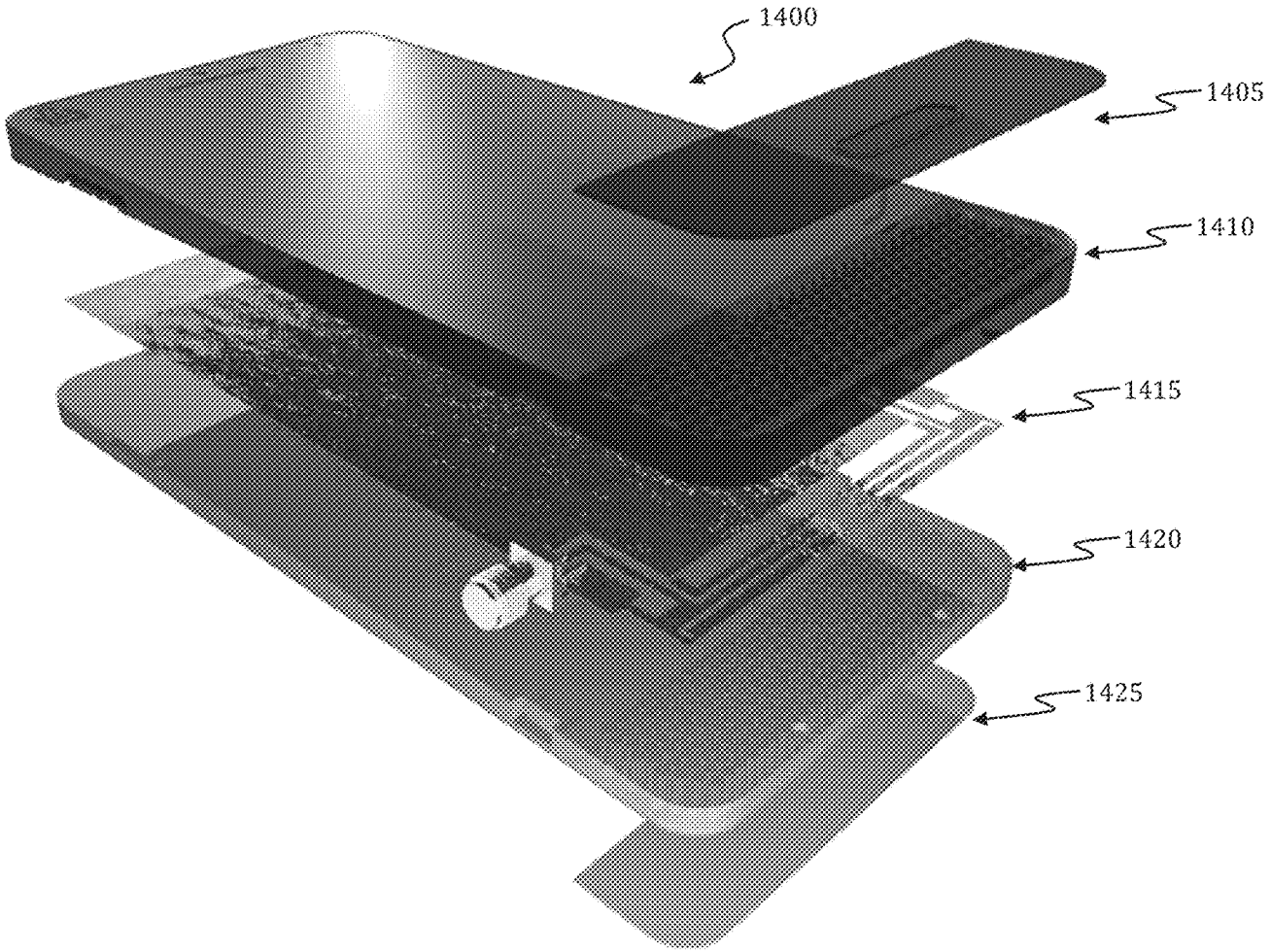
FIG. 14 illustrates a mobile device with an integrated SVAM in accordance with an embodiment of the invention.
Figure 15:
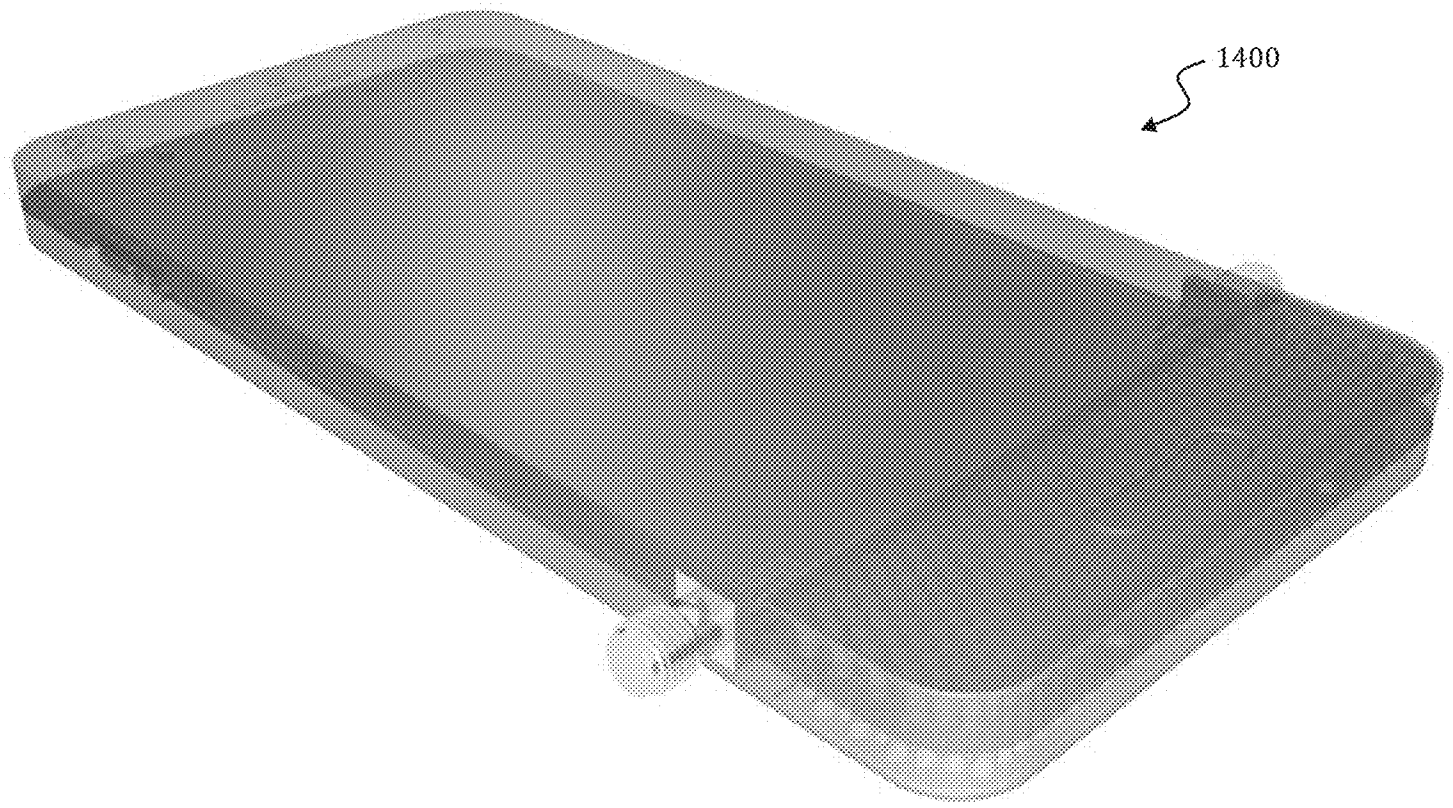
FIG. 15 illustrates a mobile device with an integrated SVAM design in accordance with an embodiment of the invention.

The design for fully 3D printed cell phone 1400 is shown in FIG. 14 and FIG. 15. The cell phone contains two antennas, a ground plane, and two coaxial connectors in structural layer 1415. Structural layers 1410 and 1420 are the top and bottom halves, respectively, of the cell phone. These layers contain an array of holes around the antennas to form the AM and/or SVAM. The holes where backfilled with high permittivity powder. Lids 1405 and 1425 were used to contain the powder in holes.

Figure 16:
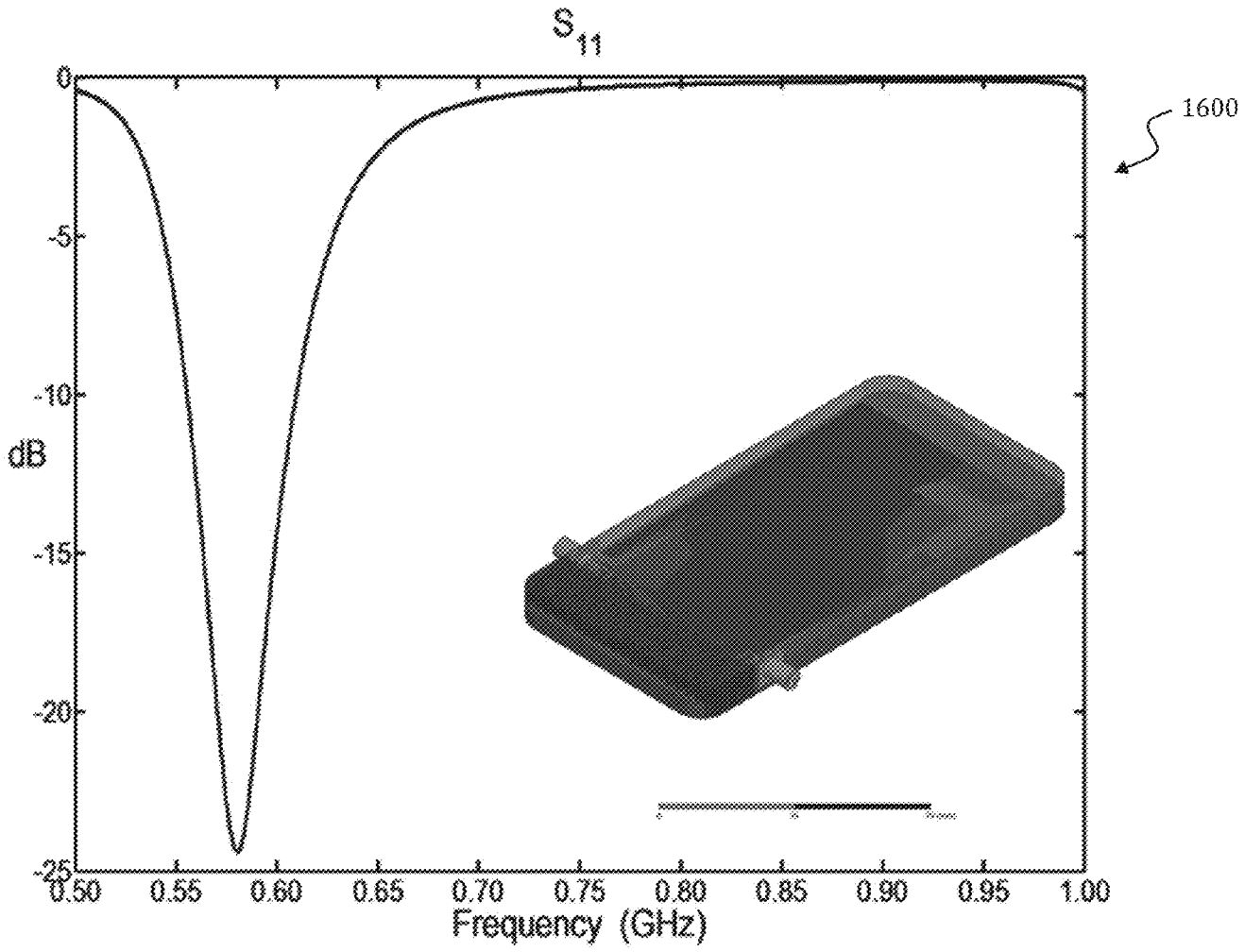
FIG. 16 illustrates a chart simulating the S11 from one of two antennas in a cell phone with SVAM in accordance with an embodiment of the invention.

SVAM Design to Reduce the ECC. A hexagonal unit cell was designed with circular rods. The rods had a dielectric constant of 27, which was chosen because Laird™ has a reliable dielectric powder with that value. The outer part of unit cell was set to be 2.57, the dielectric constant of the stereolithography resin used in the experiments. The two IFA design was then simulated with the SVAM built into the surrounding phone case. FIG. 14 and FIG. 15 illustrate an example of a phone case with antenna layer 1415 embedded in SVAM layers 1410 and 1420. The SVAM layers have coverlayers or lids 1405 and 1425. The results are shown in chart 1600 illustrated in FIG. 16.

Figure 17:
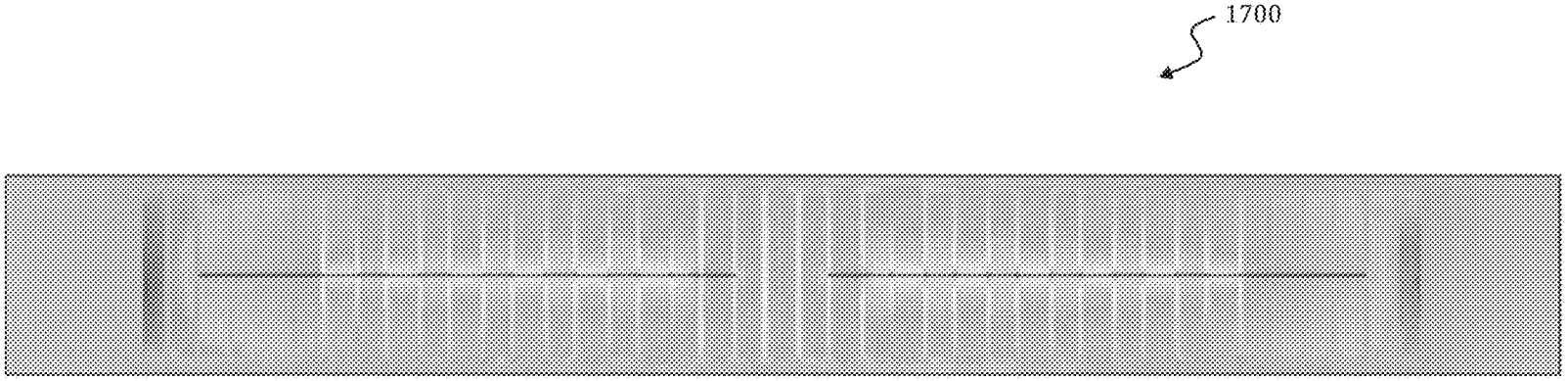
FIG. 17 illustrates a near-field of two IFA's embedded in a SVAM in accordance with an embodiment of the invention.

With the SVAM incorporated, the simulated return loss of the first IFA, even with the presence of the second IFA, is extremely similar to the return loss of one IFA by itself. The resonant frequency has shifted to a lower frequency and is a bit wider, but that is expected because the overall surrounding dielectric constant has increased. The decoupling of the antennas can be visualized by looking at the near-field illustration 1700 shown in FIG. 17.

Figure 18:
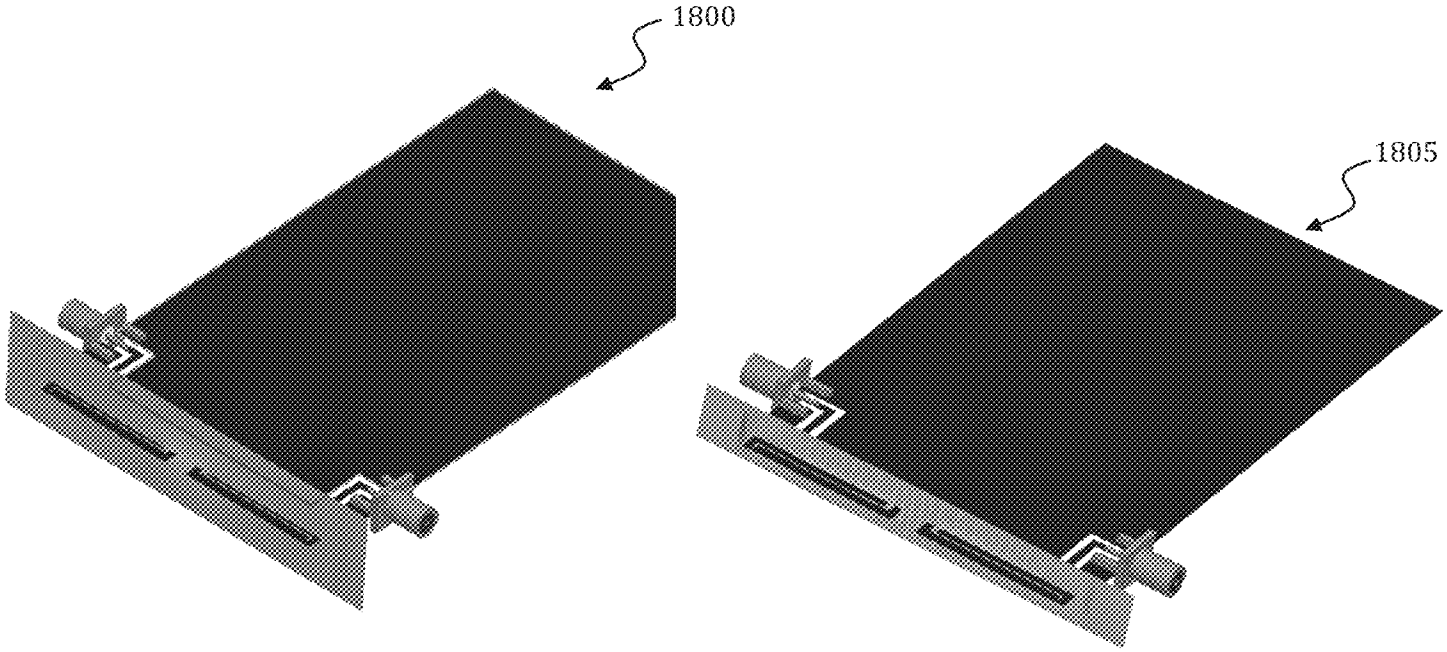
FIG. 18 illustrates a side by side view of two near-field antennas, in accordance with an embodiment of the invention.

Comparison of near-field of two antennas, with and without the SVAM in place are shown in FIG. 18. The near-field of an antenna 1800 is shown without the SVAM in place and strong fields are observed between the antennas showing the coupling. The near-field of an antenna 1805 is shown with the SVAM in place. No strong fields coupling the two antennas are observed.

Figure 19:
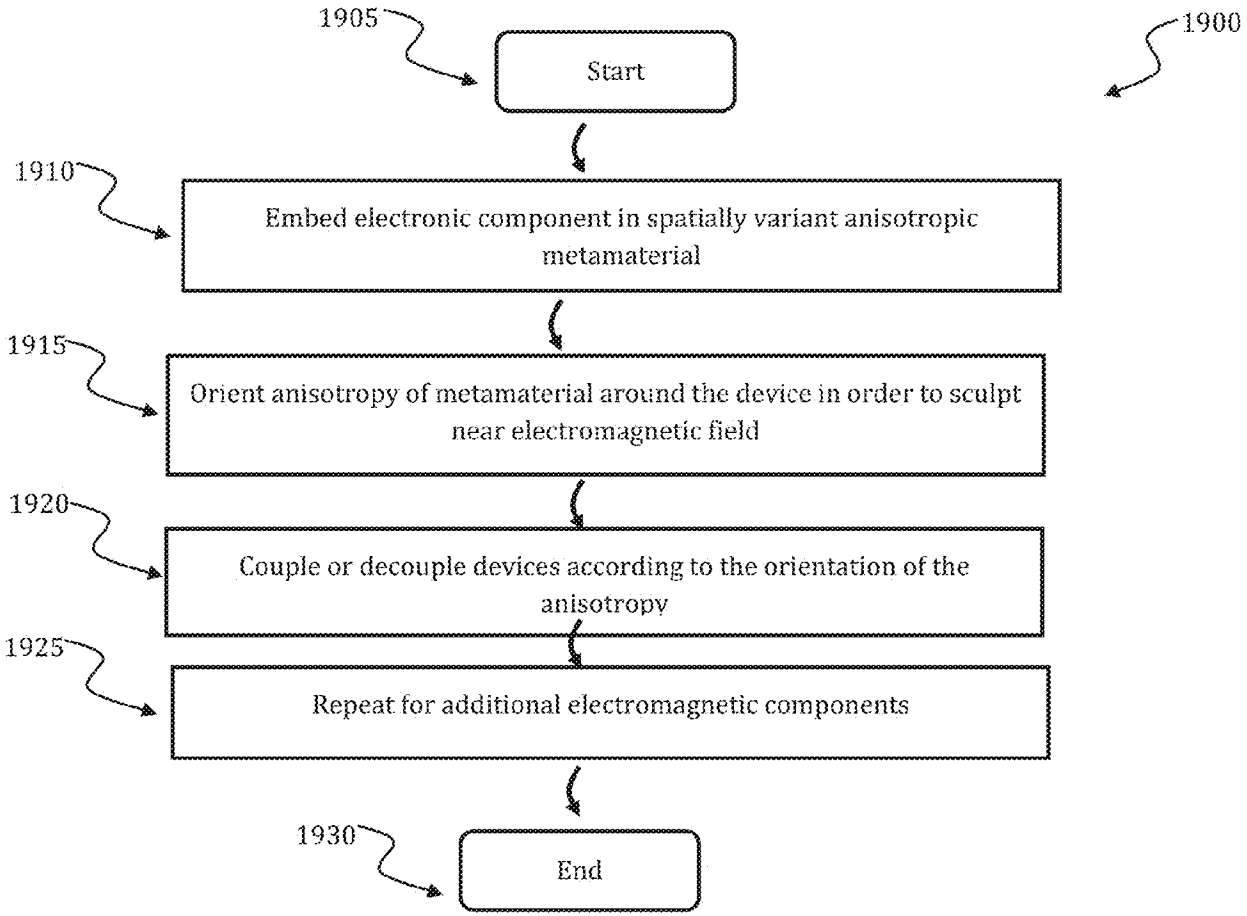
FIG. 19 illustrates a flow chart of logical operational steps associated with a method, in accordance with an embodiment of the invention.

FIG. 19, illustrates a flow chart 1900 of logical operational steps associated with a method in accordance with the embodiments herein. The method starts at 1905. At 1910, an electronic component is embedded in a spatially variant anisotropic metamaterial. At 1915 the metamaterial is oriented to sculpt the near electromagnetic field. At 1920, the sculpting is used to couple or decouple devices. At step 1925, this may optionally be repeated for additional nearby electromagnetic components. The method ends at 1930.

Based on the foregoing, it can be appreciated that a number of embodiments, preferred and alternative, are disclosed herein. For example, one embodiment comprises a device having one or more electromagnetic components embedded in an anisotropic metamaterial (AM) comprising an array of asymmetric unit cells comprising a substrate forming a plurality of channels or spaces having at least one material with different electromagnetic properties included in the channels or spaces in the first material forming an anisotropic metamaterial.

In another embodiment, the anisotropic metamaterial is a spatially variant anisotropic material (SVAM). In another embodiment, the high dielectric material is a metal oxide. In another embodiment, the metal oxide is a titanium dioxide. In another embodiment, the low dielectric material is a thermoplastic. In another embodiment, the thermoplastic is polycarbonate. In another embodiment, the channels or spaces have a size that is nonresonant with a wavelength of electromagnetic wave utilized by the electronic component embedded in the SVAM. In another embodiment, the AM has a lattice spacing of less than $\lambda/4$. In another embodiment, the electronic component is an antenna. In another embodiment, the antenna is an inverted F antenna (IFA). In another embodiment, the electronic component is a transmission line. In another embodiment, the AM is an all-dielectric AM.

In another embodiment a method for sculpting near electromagnetic field surrounding an electronic component using spatially variant anisotropic metamaterial comprises embedding the electronic component in a spatially variant anisotropic metamaterial, orienting anisotropy of the metamaterial around the device to sculpt near electromagnetic field surrounding the electronic component to render the electronic component compatible with a second or more electronic component(s). In another embodiment, one electronic component is an antenna. In another embodiment, the sculpting of near electromagnetic field is used to couple two or more electronic components. In another embodiment, the method further comprises sculpting near electromagnetic fields of two or more electromagnetic components, wherein the near electromagnetic fields are compatible in close proximity.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A device having one or more electromagnetic components embedded in an anisotropic metamaterial (AM) comprising an array of asymmetric unit cells comprising a substrate comprising a first material forming a plurality of channels or spaces having at least one material with different electromagnetic properties included in the channels or spaces in the first material forming an anisotropic metamaterial.

2. The device of claim 1, wherein the anisotropic metamaterial is a spatially variant anisotropic material (SVAM).

3. The device of claim 1, wherein the first material comprises a metal oxide.

4. The device of claim 3, wherein the metal oxide is a titanium dioxide.

5. The device of claim 1, wherein the first material comprises a thermoplastic.

6. The device of claim 5, wherein the thermoplastic is polycarbonate.

7. The device of claim 1, wherein the channels or spaces have a size that is nonresonant with a wavelength of electromagnetic wave utilized by the electronic component embedded in the SVAM.

8. The device of claim 1, wherein the AM has a lattice spacing of less than $\lambda/4$.

9. The device of claim 1, wherein the electronic component is an antenna.

10. The device of claim 9, wherein the antenna is an inverted F antenna (IFA).

11. The device of claim 1, wherein the electronic component is a transmission line.

12. The device of claim 1, wherein the AM is an all-dielectric AM.

13. The system of claim 1, wherein the electronic component comprises at least one of:

an antenna;

an inverted F antenna (IFA); and a transmission line.

14. A method for sculpting near electromagnetic field surrounding an electronic component using spatially variant anisotropic metamaterial comprising:

embedding the electronic component in a spatially variant anisotropic metamaterial;

orienting anisotropy of the metamaterial around the device to sculpt near electromagnetic field surrounding the electronic component to render the electronic component compatible with a second or more electronic component(s).

15. The method of claim 14, wherein one electronic component is an antenna.

16. The method of claim 14, wherein the sculpting of near electromagnetic field is used to couple two or more electronic components.

17. The method of claim 14, further comprising sculpting near electromagnetic fields of two or more electromagnetic components, wherein the near electromagnetic fields are compatible in close proximity.

18. A system comprising:

one or more electromagnetic components embedded in an anisotropic metamaterial (AM) comprising an array of asymmetric unit cells comprising a substrate forming a plurality of channels or spaces having at least one material with different electromagnetic properties included in the channels or spaces in the first material forming an anisotropic metamaterial.

19. The system of claim 18, wherein the anisotropic metamaterial is a spatially variant anisotropic material (SVAM).

20. The system of claim 19, wherein the AM has a lattice spacing of less than $\lambda/4$.

* * * * *